US006997237B2

(12) United States Patent
Baumgartner

(10) Patent No.: US 6,997,237 B2
(45) Date of Patent: Feb. 14, 2006

(54) DIE-CASTING OR INJECTION MOLDING MACHINE

(75) Inventor: Dominik Baumgartner, Blonay (CH)

(73) Assignee: Fondarex SA, St. Legier (CH)

( * ) Notice: Subject to any disclaimer, the term of this patent is extended or adjusted under 35 U.S.C. 154(b) by 0 days.

(21) Appl. No.: 10/915,833

(22) Filed: Aug. 11, 2004

(65) Prior Publication Data

US 2005/0115693 A1 Jun. 2, 2005

(30) Foreign Application Priority Data

Aug. 25, 2003 (EP) ..... 03019142

(51) Int. Cl.
*B22D 17/00* (2006.01)

(52) U.S. Cl. ..... 164/312; 164/155.1

(58) Field of Classification Search ..... 164/155.1, 164/155.2, 113, 312
See application file for complete search history.

(56) References Cited

U.S. PATENT DOCUMENTS 4,986,338 A * 1/1991 Yamauchi et al. ..... 164/457
5,361,826 A * 11/1994 Yamauchi et al. ..... 164/457
5,983,978 A * 11/1999 Vining et al. ..... 164/312

* cited by examiner

*Primary Examiner*—Len Tran
(74) *Attorney, Agent, or Firm*—Grant E. Coffield; Arnold B. Silverman; Eckert Seamans Cherin & Mellott, LLC

(57) ABSTRACT

A die casting machine or an injection molding machine comprises a pressure member, such as a casting piston in a shot sleeve or extruder screw in an extruder barrel. A control unit is associated to this pressure member and/or to a filling system for filling the shot sleeve or the barrel. Moreover, an evacuation device is provided which includes a vacuum valve that communicates with the cavity of the die or mold, on the one hand, and a vacuum conduit on the other hand. This vacuum valve may be moved from an open position interconnecting the cavity and the vacuum source, and a closed position. There is a control connection between the control unit and the valve. The positions of the valve can be controlled by a material sensor located in its region and associated to it, the sensor supplying a closure signal to the valve through an output line. This output line, however, is also coupled to the control unit for influencing and controlling at least one of its controlled parts, i.e. pressure member and/or filling system.

18 Claims, 3 Drawing Sheets

DIE-CASTING OR INJECTION MOLDING MACHINE

FIELD OF THE INVENTION

This invention relates to a molding machine, particularly a die-casting or an injection molding machine, for molding material which, in the case of a die-casting machine, is molten metal, particularly a non-iron metal, while in the case of an injection molding machine, it is a plastic material.

Both types of machines work in a quite similar way and comprise means forming a mold having a cavity, and a conduit system leading to this cavity. According to one aspect of the present invention, a pressure member is provided (in both types of machines) which is moveable towards the cavity to press material to be molded through the conduit system into the cavity. This pressure member, for either type of material, may be of very different sort: either it is formed by a piston moveable in a shot sleeve (as part of the conduit system) or by an extruder moveable in an extruder barrel.

Of course, there is a controlling arrangement for the movement of the pressure member which, in some cases, comprises at least one sensor having an output for sensing arrival of the material in its path from the conduit system to the cavity and providing an output signal for controlling the movement of said pressure member, because this movement is mostly effected in different phases of different velocity In this way, the material is pressed into the cavity which is preferably evacuated to minimize voids in the material. To this end, an evacuating device is provided which comprises a vacuum source, vacuum conduit system that interconnects the vacuum source and the cavity, and at least one vacuum valve in the vacuum conduit system located at said mold means. This vacuum valve is moveable between an open position to allow evacuation and a closed position to prevent material pressed into the cavity to enter the vacuum conduit system.

According to a second aspect of the invention, at least one pressure member is moveable in and to at least part of that hollow space system and toward said cavity, which is formed by the conduit system and the cavity. This is done after the cavity has been filled with molten material which, by then, solidifies and shrinks. The at least one pressure member is then moved towards the cavity in order to fill shrinking voids and, thus, to control the amount of material filling the cavity.

BACKGROUND OF THE INVENTION

Vacuum valves, as used in both aspects of the invention, according to the prior art are often controlled in dependence upon the position of a pressure or casting piston (or other pressure member) with a certain time delay so that they close in time to avoid escape of material through the valve. Examples of such control systems can be found in U.S. Pat. Nos. 2,837,792; 2,904,861; 3,349,833; 4,463,793 or 4,577,670. It is clear that the position of the pressure member gives merely an approximate indication where the front of material (the metal in the case of a die-casting machine or the plastic material in the case of an injection molding machine) actually is. That is for the actual position of the front of material will also depend upon the filling degree or degree of admission within the shot-sleeve or within the extruder barrel and may vary with fluctuation of the dosed and supplied amount of material.

This unsatisfactory condition could be solved by assigning to the vacuum valve at least one sensor of a type which is able to react quickly enough to determine arrival of the front of material in the region of the cavity, particularly near the vacuum valve, and to close the vacuum valve in time. Recently, such quickly reacting sensors have been developed.

SUMMARY OF THE INVENTION

It is an object of the present invention to make use of such quickly reacting sensors in a more efficient way, thus enabling a more efficient control than by the usual aggregation of a machine of the type described, and an evacuation device which is generally a more or less separate system attached to the machine.

According to the invention, the solution of the problem is made in two steps, i.e. that a) the above-mentioned positions of the valve may be controlled by a material sensor which is associated to the valve and is situated in vicinity of the valve to supply a closing signal to the valve via an output line, and that b) this output line is coupled to the control unit which either controls the pressure member or the filling system responsible for the amount of material filled into the conduit system (e.g. shot-sleeve or extruder barrel) or both.

In this way, the control unit is simplified by using the material front sensor provided for the vacuum valve also for the purpose of controlling the pressure member and/or the filling system (that, in general, will be coupled to the control of the pressure member anyway).

A further simplification is achieved, if at least part of the control device, being in common for the vacuum valve and the pressure member and/or filling system, is accommodated in common in a housing. For up to now, the evacuation system had mostly been considered as a mere supplement or accessory and, therefore, had a control for its own which was separately positioned so that freely lying connecting cables were subjected to the risk of being damaged by hot material, such as hot metal, and constituted also a risk to the personnel. By accommodating the control devices for both the evacuating system and the pressure and/or filling system in a housing in common, a compact and space saving construction is achieved, thus not only avoiding that separate housings are placed in the region of the machine, but also reduces the risk of burning cables by hot material or liquid metal.

BRIEF DESCRIPTION OF THE DRAWINGS

Further details and characteristics of the invention will become apparent from the following description of embodiments schematically illustrated in the drawings in which:

FIG. 3 is a cross-sectional view through a shot-sleeve and a stationary half of a die for describing the invention with reference to a monitoring system for the amount of material filled in.

DETAILED DESCRIPTION OF THE DRAWINGS

Figure 1:
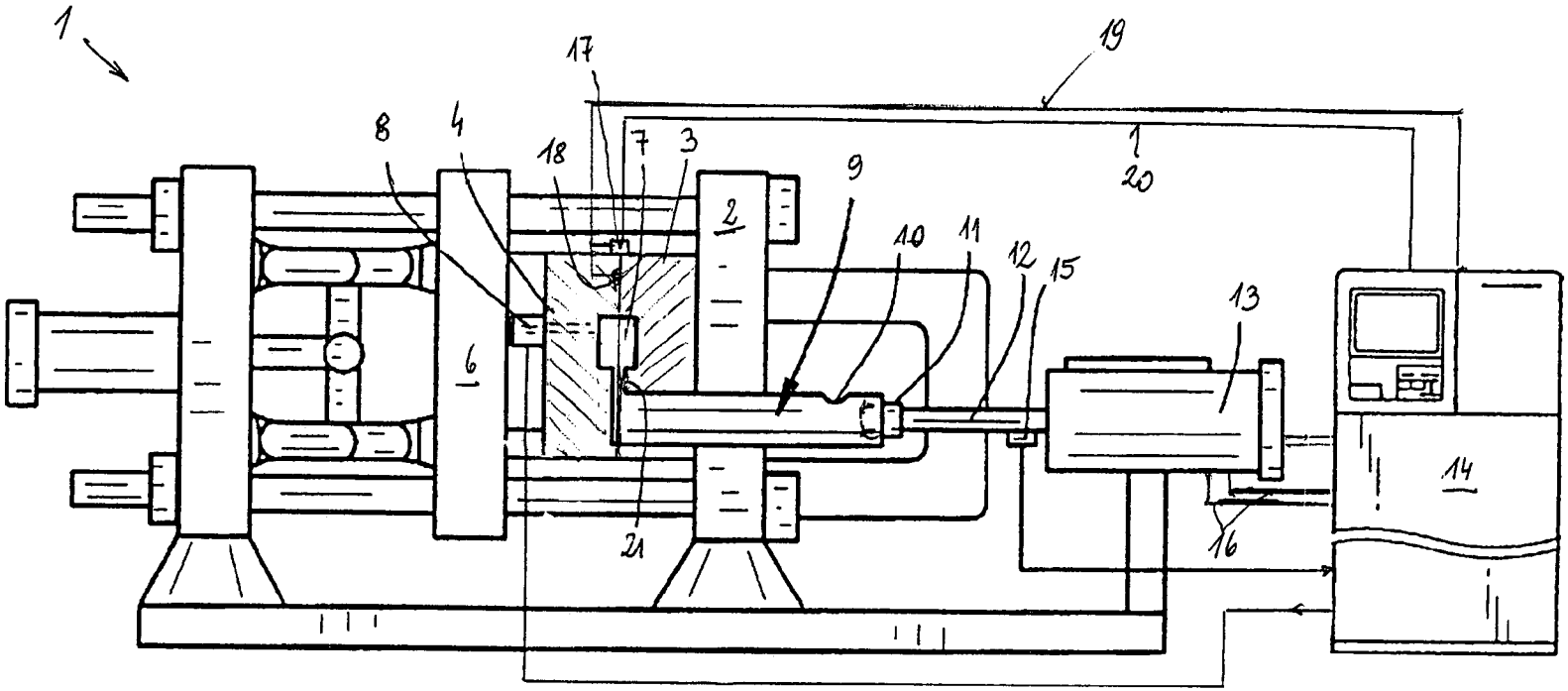
FIG. 1 is a lateral view of a die-casting machine according to the invention.

A die-casting machine 1 comprises, as usual, a stationary die clamping plate 2 onto which a stationary die half 3 is mounted. This stationary die half 3 together with a moveable die half 4, fastened to a moveable die clamping plate 6, defines a die cavity 7. To this die cavity 7, optionally an external after-pressure arrangement 8 (in contrast to an internal after-pressure arrangement moveable in the shot sleeve and being either formed by a shot piston 11 itself or by a piston displaceably supported within the shot piston and being advanced from it towards the cavity, a construction known under the name "Acurad" piston), the external after-pressure device being known per se and, therefore, only schematically illustrated in FIG. 1.

A shot sleeve 9 having a filling hole 10 is fastened to the stationary die half 3. A casting piston 11 is displaceable in this shot sleeve 9 by means of a hydraulic drive unit 13 which acts upon its piston rod 12 in order to press metal, that has been filled into the shot sleeve 9 through the filling hole 10, into the die cavity 7. The hydraulic drive unit 13 is controlled by a control unit 14 which may encompass both electric-electronic components as well as at least part of the hydraulics. To this end, a position sensor and or velocity sensor and/or acceleration sensor 15 as well as other sensors, such as pressure sensors, are coupled to the control unit 14 via lines 16, as is known per se.

All these components and their mutual association are known in the art and may be modified in any manner desired within the scope of the invention. It is also known to mount a vacuum valve 17 within the region of the parting plane of both die halves 3, 4. This vacuum valve 17 is controlled, in the present case, by a quickly reacting metal front sensor 18. The reaction speed of this sensor 18 is such that the valve is still able to close a vacuum conduit 20 in the region of the die halves 3, 4 within a time period which passes up to the moment when the metal arrives from the sensor 18 to the valve 17. The vacuum conduit 20, instead of comprising a separate control unit which includes a vacuum pump and a vacuum tank (as a vacuum source) and so on, is advantageously coupled to that device 14 which also controls the movement of the casting piston 11 so that the parts belonging to the control of the evacuation device are accommodated in the housing where the control unit of the piston 11 are mounted, and no separate control parts have to be provided. By the way: it is also known to attach a control unit to the machine frame of an injection molding machine or a die-casting machine, and this would also possible in the present case.

As will be described later with reference to FIG. 2, the output line 19 of the metal front sensor 18 is also coupled to the control unit 14. The control unit 14, in response to the output signal of the sensor 18 which provokes closing of the valve 17, may also release a so-called after-pressure phase movement. This may either be done by moving the casting piston 11 (or a so-called Acurad piston moveably supported in the casting piston) after it has filled the cavity 7 with molten metal in order to fill the cavity completely when its contents, the metal, solidifies and shrinks. Alternatively or in addition, the external after-pressure arrangement 8 may be used. In this way, the output signal of the sensor 18 is utilized for two purposes and no separate sensor is necessary for releasing the after-pressure phase. Thus, the construction of the control unit 14 is simplified. For this reason, the lines 19, and optionally also 20 (the later leading to the vacuum source in the control cabinet 14), constitute the controlling connection between the valve 17 and the control unit 14.

Figure 2:
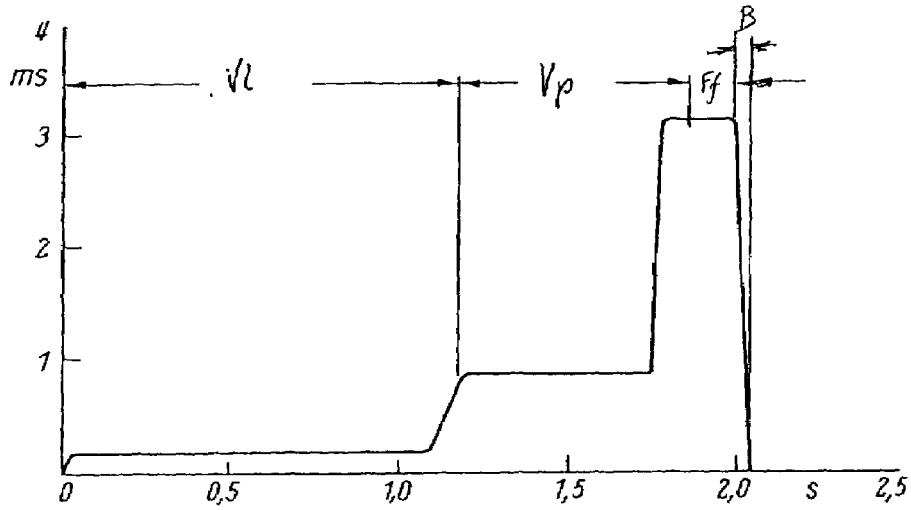
FIG. 2 is a diagram for explaining the control of a first embodiment.

FIG. 2 shows a velocity diagram (the velocity being in m/s in relation to time in s) of the casting piston 11, as is known from the book "Moderne Druckgussfertigung" by Ernst Brunnhuber, publishing house Schiele & Schön GmbH, Berlin, 1971. Accordingly, there is first a slow pre-stroke phase Vl wherein the piston 11 is displaced just over the filling hole 10, the slow velocity, thus, preventing metal from spraying out of the hole 10. Subsequently, the velocity of the casting piston 11 is increased in a first running phase Vp that continues up to the moment when the metal front has reached the gate 21 (FIG. 1) which will result in a first pressure peak. The following procedure of filling the die is very quickly effected during a short die filling phase Ff during which the die cavity 7 (FIG. 1) is filled with metal. It should be noted that these phases are quite similar in injection molding of plastic material.

The end of this die filling phase Ff is relative critical, because the pressure exerted by the casting piston 11 can no longer convert itself into movement of the melt as soon as the die has completely been filled. If the casting piston continued to move in an unbraked manner, a dynamic pressure peak would result which would cause a so-called "die respiring" where both die halves for a short time move from one another so that metal (or plastic material in case of an injection molding machine) may escape into the inter-space and solidify there. This would form burrs which require very arduous deburring work. Therefore, initiating a braking phase is particularly important.

According to the present invention, the output signal of the sensor 18 may not only be used to close the vacuum valve 17 (and, optionally, to initiate the after-pressure phase), but also to initiate the braking phase B. This may be done in such a way that, in response of the output signal of the sensor 18, the braking phase B is initiated first which would, in general, require that the sensor 18 is arranged relative far before the valve 17. Then, after a certain time delay, the after-pressure phase may be initiated, if desired. Another possibility of utilizing the output signal of the sensor 18 may consist in that the control unit 14 provides a predetermined or adjustable period for the die filling phase Ff and a subsequent braking phase B, however that the curve of the braking phase B is displaceable in time by the, thus, correcting output signal of the sensor 18 with respect to the curve of the die filling phase Ff.

The time period from the beginning of the pre-stroke phase Vl up to the end of the braking phase B is for example, according to the above-mentioned book by Brunnhuber, a little bit more than 2 s. This period, of course, depends also upon the fact to which degree the shot sleeve 9, constituting a conduit to the cavity 7, is filled with material (metal) at all.

In order to have this degree under control, a variety of filling systems are known. For example, JP-A-2001-18053 shows a filling system in which the quantity of metal is, in some way, "pre-proportioned" by feeding molten metal from a furnace into a metering space whose volume is defined in upward direction by a metering piston. The position of this metering piston defines the quantity of metal fed into this metering space before this quantity is filled into the shot sleeve below. Similar filling systems are disclosed in SU-A-438 496 and 569 383. Other filling systems, however, use filling level sensors to determine the quantity of metal filled into the shot sleeve. This is known, for example, from DE-A-196 17 237 or DE-A-43 44 411. Which one of these different types of filling systems is used within the scope of the present invention is not critical and any construction may be used. However, in the following and by way of example, a filling system using a filling level measurement shall be described with reference to FIG. 3. Parts of the same function will have the same reference numeral as in FIG. 1.

Figure 3:
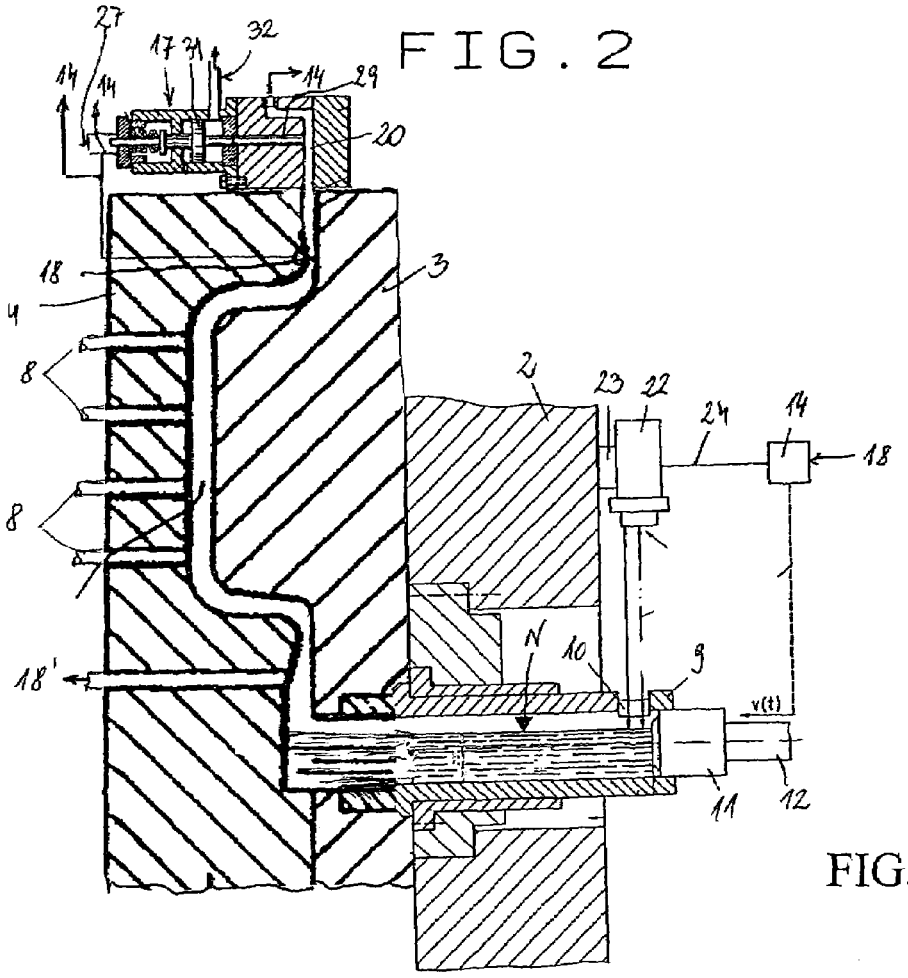

According to FIG. 3 a range finder 22, which, for example, is operated in accordance with the time-of-flight principle, e.g. a laser range finder or (less preferred) an ultrasound range finder, is arranged on a bracket 23. This range finder 22 measures the distance to the metal level N in the shot sleeve 9. Of course, this distance will vary with the actual filling level or the level N so that it constitutes a measure of the filling level in the shot sleeve 9. Since, as mentioned above, the initiation of the phases Vl, Ff and B described above with reference to FIG. 2, the level sensor or range finder 22 is coupled to the control unit by a line 24 in order to adapt the curves according to FIG. 2 to the filling level as measured.

The fact that the time-of-flight in air of different temperature may vary, and that, in addition, the hot raising air and ambient air are subjected to some turbulence has as a consequence that the filling level as measured coincides with the actual filling level only within a certain range of tolerance afflicted with error. For example temperature fluctuations dependent on the season or on weather, air current and so on may result in measuring differences. For all these cases, the present invention results in a considerable improvement in that the output signal of the sensor 18, apart from causing closure of the vacuum valve 17, is used as a correction signal for the control unit 14, as is indicated in FIG. 3 by line 24. For attaining a level, that is preferably given as a nominal value by the sensor 18, will, of course, depend first in the measured value of the level N, but can be determined with much more precision by the correcting value, although correction is made afterwards.

It has already been mentioned above that filling systems can be constructed in a very different way and may comprise a metering receptacle. If one has a construction according to JP-A-2001-18053 wherein a displaceable metering piston defines the metered level, correction by the output signal of the sensor 18 could be realized by providing a servo-drive for a displacement and adjustment of the position of the metering piston. In short, in the case of a filling system having a metering device, the arrangement, that defines the metered or dosed quantity of metal or plastic material, can be adjusted by the output signal of the sensor 18 which, in principle, is assigned to the vacuum valve 17.

The vacuum valve 17 corresponds substantially to that of U.S. Pat. No. 3,349,833, but is controlled by an electromagnet 27 which is able to displace a closure slider 29 into the conduit 20 in order to cause the vacuum valve 17, starting from its open position, to assume its closed position. Alternatively, however, the electromagnet 27 may be detached, and actuation is effected in a pneumatic or hydraulic way by a piston 31. In case of using an electromagnet 27, the associated fluid conduits (only one conduit 32 is represented) remain open in order not to cause a resistance against displacement of the piston 31. It is clear, however, that this has only to be considered as an example and any type of vacuum valve could be used within the scope of the present invention.

Figure 4:
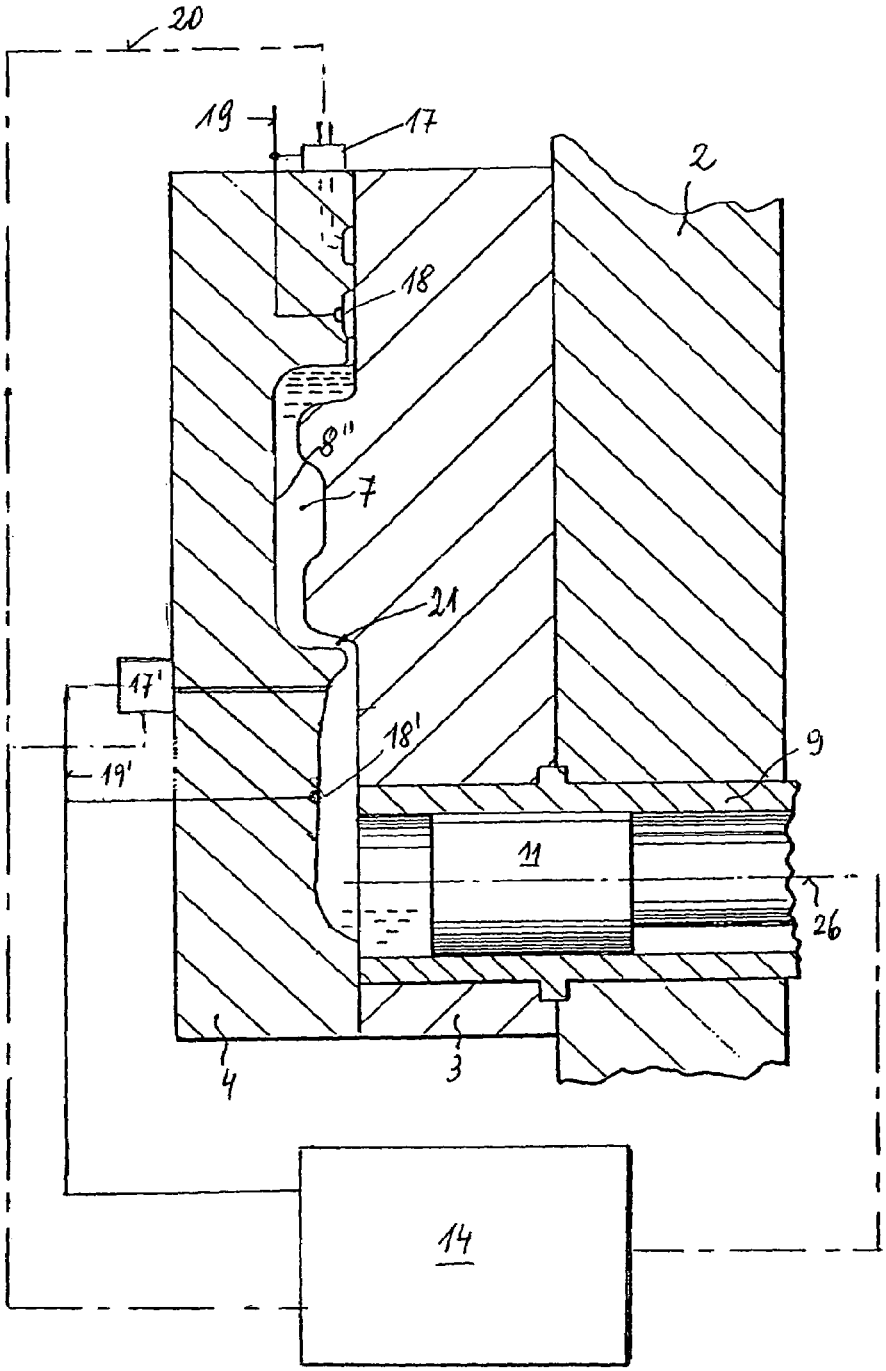
FIG. 4 represents a further embodiment having a multiple evacuation.

Just in a case where the die cavity 7 has a relative complicated shape so that different resistances against the suction flow of the evacuation device including the valve 17 will result at different places, it has already been suggested to provide suction conduits at different places, e.g. at both ends of the die (when seen in the direction of flow of the material or metal). Such a construction of multiple vacuumizing is represented in FIG. 4. Also in this case, parts of the same function have the same numerals as in the previously described figures.

FIG. 4 shows again both die halves 3, 4 forming a cavity 7. At the upper side of the two die halves 3, 4 is the vacuum valve 17, described already with reference to FIG. 1, as well as the vacuum conduit 20 fed by the control unit 14 (which includes the vacuum source) and the output line 19 of the sensor 18 that leads to the control unit 14. Shortly before the gate 17, however, a further vacuum valve 17' is provided. This vacuum valve 17' is controlled by a metal front sensor 18' which, as is known per se, serves the control of the movement of the casting piston 11, as is, for example, disclosed in DE-A-36 35 845. Traditionally, the output signal of this sensor 18' is used for switching over the control from the slower movement during the first running phase Vp (see FIG. 2) to the faster Filling phase Ff. According to the present invention, however, the sensor 18' is also associated to the vacuum valve 17' and feeds its output signal through an output line 19' to it in order to bring it into its closed position.

Numerous modifications are possible within the scope of the present invention; in all cases, it is important that a sensor associated to a vacuum valve influences also the control of the respective pressure member and/or the filling system of an injection molding machine or of a die-casting machine. For example, a plurality of openings could be provided instead of a single opening 17", or such opening extends in axial direction and may be triangular, e.g. with the tip facing the die cavity 7 in order to close it gradually.

What is claimed is:

1. Molding machine for molding material comprising
means for forming a mold having a cavity;
a conduit system leading to said cavity;
pressure means comprising at least one pressure member moveable towards said cavity to press said material through said conduit system into said cavity;
control means for the controlling movement of said pressure member to fill said cavity with said material and, after shrinking of said material occurs, to provide an after-pressure,
said control means including at least one sensor for sensing the arrival of said material in its path from said conduit system to said cavity and providing an output signal for controlling said movement of said pressure member;
evacuating means including
vacuum source means,
vacuum conduit means interconnecting said vacuum source means and said cavity, and
at least one valve means in said vacuum conduit means at said mold means, said valve means being moveable between an open position and a closed position;
wherein said control means, in addition to controlling said movement of said pressure member to provide said after-pressure, is also structured to control said valve means, said output signal of said at least one sensor of said control means being interconnected with said valve means in order that, upon sensing the arrival of said material at said sensor in its path from said conduit system to said cavity, said control means is structured to move said valve means into its closed position.

2. Molding machine as claimed in claim 1, wherein it is a die-casting machine for molding metal.

3. Molding machine as claimed in claim 2, wherein said conduit system comprises a shot sleeve, while said pressure member comprises a piston moveable in said shot sleeve.

4. Molding machine as claimed in claim 1, wherein it is an injection molding machine for molding plastic material.

5. Molding machine as claimed in claim 4, wherein said conduit system comprises an extruder barrel and at least, one extruder screw moveable in said extruder barrel.

6. Molding machine as claimed in claim 1, wherein at least part of said control means, which control both said movement of said pressure member and said valve means, comprise housing means in common.

7. Molding machine as claimed in claim 1, wherein said control means control braking the movement of said pressure member upon receiving said output signal fed also to said valve means for movement into said closed position.

8. Molding machine as claimed in claim 1, further comprising gate means forming a constriction between said cavity and said conduit means, said pressure member moving with different velocities, the velocity when filling said cavity with said material during a filling phase being higher than before, wherein said at least one sensor is situated in said conduit means before said gate means and controls both the positions of said at least one valve means and the beginning of said filling phase.

9. Molding machine for molding material comprising means forming a mold having a cavity;

a conduit system leading to said cavity;

filling means for filling said material into said conduit system;

control means for controlling said filling means and including at least one sensor having an output for sensing arrival of said material in its path from said conduit system to said cavity and providing an output signal for controlling said filling means;

evacuating means including vacuum source means, vacuum conduit means interconnecting said vacuum source means and said cavity, and at least one valve means in said vacuum conduit means at said mold means, said valve means being moveable between an open position and a closed position;

means interconnecting the output of said at least one sensor and said valve means to control also said positions, said output signal upon arrival of said material provoking said valve means to move into said closed position.

10. Molding machine as claimed in claim 9, wherein it is a die-casting machine for molding metal.

11. Molding machine as claimed in claim 10, wherein said conduit system comprises a shot sleeve, while said pressure member comprises a piston moveable in said shot sleeve.

12. Molding machine as claimed in claim 9, wherein it is an injection molding machine for molding plastic material.

13. Molding machine as claimed in claim 12, wherein said conduit system comprises an extruder barrel and at least, one extruder screw moveable in said extruder barrel.

14. Molding machine as claimed in claim 9, wherein said filling means comprise dosing means for dosing the amount of material filled into said conduit means, said amount of material being adjustable by said output signal of said sensor means.

15. Molding machine for molding material comprising means forming a mold having a cavity to be filled with molten material;

a conduit system leading to said cavity, thus forming a system of interconnected hollow spaces;

at least one pressure member moveable in and to at least part of said hollow space system toward said cavity at least after said cavity has been filled with said molten material;

control means for the movement, of said pressure member, said control means including at least one sensor near said cavity, the sensor having an output for sensing arrival of said material in its path into said cavity and providing an output signal for controlling said movement of said at least one pressure member towards said cavity after said cavity has been filled with said molten material;

evacuating means including vacuum source means, vacuum conduit means interconnecting said vacuum source means and said cavity, and at least one valve means in said vacuum conduit means at said mold means, said valve means being moveable between an open position and a closed position;

means interconnecting the output of said at least one sensor and said valve means to control also said positions, as to provoke, said valve means to move into said closed position upon arrival of said material.

16. Molding machine as claimed in claim 15, wherein said mold means comprise at least one elongated boring, and said at least one pressure member comprises at least one secondary piston means moveably supported in said boring to move in and out of said cavity for exerting after-compression to said material in said cavity, the after-compression movement of said at least one secondary piston means being controlled by said output signal.

17. Molding machine as claimed in claim 15, wherein said at least one pressure member comprises a ram in said conduit system, and said control means, when receiving said output signal, initiates braking the movement of said piston.

18. Molding machine as claimed in claim 15, wherein said at least one pressure member comprises a ram in said conduit system, and said control means, when receiving said output signal, initiates an after-pressure movement of said piston to fill said cavity completely when said material in said die has shrunk.

* * * * *